US006309330B1

(12) United States Patent
Thornton

(10) Patent No.: US 6,309,330 B1
(45) Date of Patent: Oct. 30, 2001

(54) INVERTED AB CRUNCHER

(76) Inventor: Thomas L. Thornton, 4880 N. Marine Dr., #609, Chicago, IL (US) 60640

( * ) Notice: Subject to any disclaimer, the term of this patent is extended or adjusted under 35 U.S.C. 154(b) by 0 days.

(21) Appl. No.: 09/413,775

(22) Filed: Oct. 7, 1999

(51) Int. Cl.[7] ..... A63B 26/00

(52) U.S. Cl. ..... 482/140; 482/144; 482/907; 482/91

(58) Field of Search ..... 482/140, 142, 482/144, 91, 907

(56) References Cited

U.S. PATENT DOCUMENTS 4,690,133 * 9/1987 George ..... 128/25 R
4,703,929 * 11/1987 Reed ..... 272/144
4,867,143 * 9/1989 Morin ..... 128/75
5,190,513 * 3/1993 Habing et al. ..... 482/145
5,242,345 9/1993 Mitchell .
5,277,676 1/1994 Holland et al. .
5,295,936 * 3/1994 Perry, Jr. ..... 482/144
5,302,164 * 4/1994 Austin ..... 482/91
5,456,649 10/1995 Horkey .

* cited by examiner

*Primary Examiner*—Mickey Yu
*Assistant Examiner*—Lori Baker Amerson
(74) *Attorney, Agent, or Firm*—Patent & Trademark Services; Joseph H. McGlynn

(57) ABSTRACT

A device which will allow the user to perform inverted ab crunches and has a frame which is attached to a base with a padded mat. The frame has two padded supports at the top for the user to place his knees and ankles on to support himself in an inverted position and the frame has hand holds along the frame to help himself into and out of the exercise position.

4 Claims, 1 Drawing Sheet

INVERTED AB CRUNCHER

BACKGROUND OF THE INVENTION

This invention relates, in general, to exercise devices, and, in particular, to an exercise device that allows a user to perform ab crunches in an inverted position

DESCRIPTION OF THE PRIOR ART

In the prior art various types of exercise devices have been proposed. For example, U.S. Pat. No. 5,242,345 to Mitchell discloses an apparatus which allows a user to perform a variety of exercises and which comprises a frame to which various attachments may be secured.

U.S. Pat. No. 5,277,676 to Holland discloses a free standing frame with a horizontal bar that allows a user to perform various exercises.

U.S. Pat. No. 5,302,164 to Austin discloses a device with horizontal bars which allows a user to do dips and vertical leg lifts.

U.S. Pat. No. 5,456,649 to Horkey discloses a back stretching apparatus with a vertical support tube and a horizontal bar attached to the tube.

SUMMARY OF THE INVENTION

The present invention is directed to a device which will allow the user to perform inverted ab crunches and has a frame which is attached to a base with a padded mat. The frame has two padded supports at the top for the user to place his knees and ankles on to support himself in an inverted position and the frame has hand holds along the frame to help himself into and out of the exercise position.

It is an object of the present invention to provide a new and improved exercise device for performing inverted ab crunches.

It is an object of the present invention to provide a new and improved exercise device which can be easily assembled and disassembled.

It is an object of the present invention to provide a new and improved exercise device which can be used at home or in a gym.

These and other objects and advantages of the present invention will be fully apparent from the following description, when taken in connection with the annexed drawings.

DESCRIPTION OF THE PREFERRED EMBODIMENT

Figure 1:
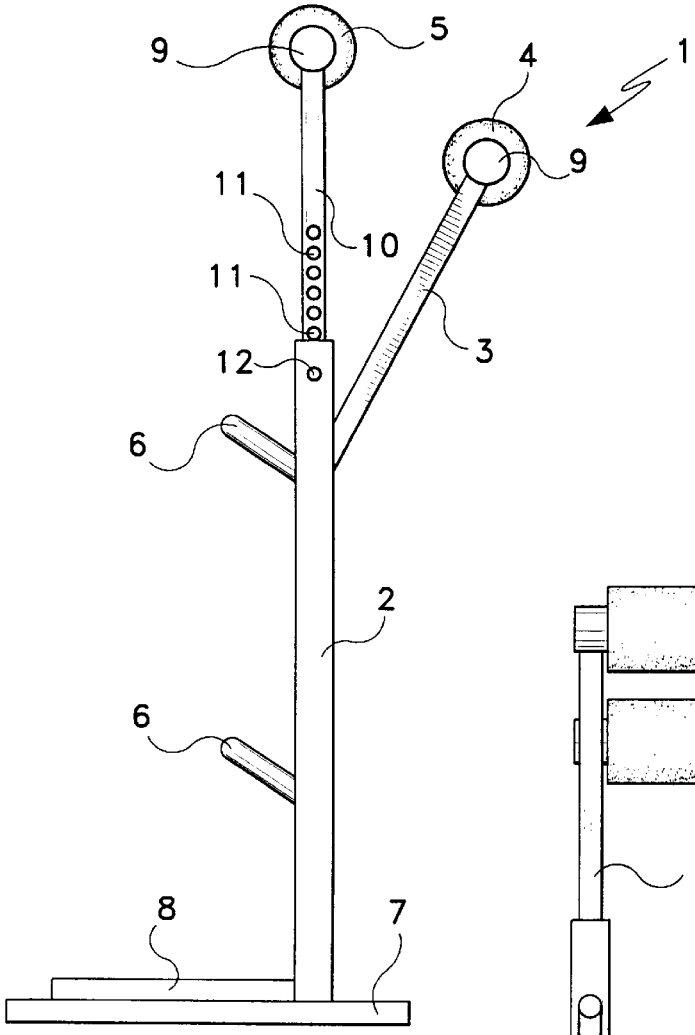
FIG. 1 is side view of the present invention.
Figure 2:
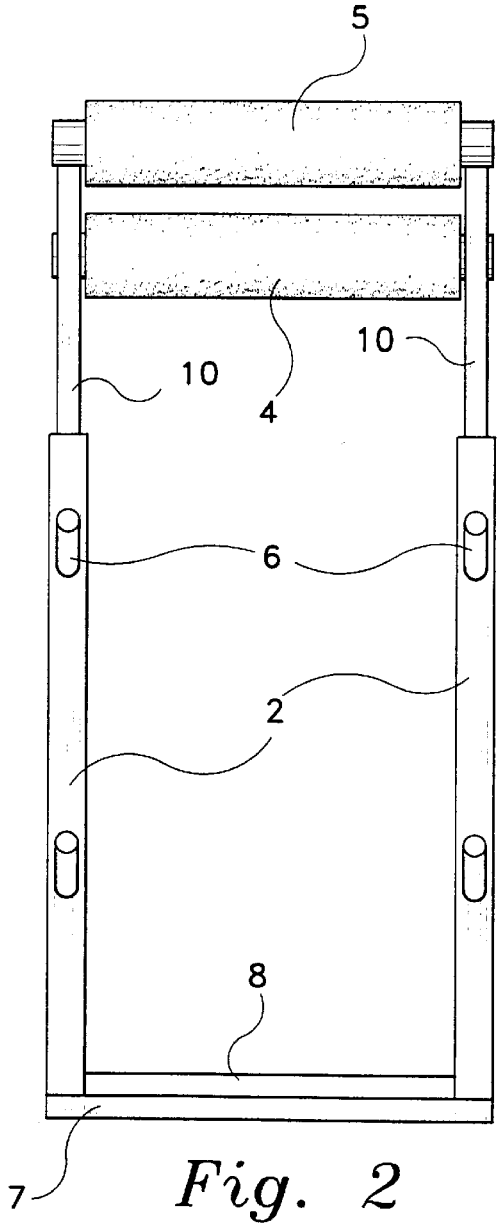
FIG. 2 is a front view of the present invention.

Referring now to the drawings in greater detail, FIG. 1 shows the exercise device 1 of the present invention. The device has a frame with two vertical supports 2 which are secured to a weighted base 7. The base can be constructed of a material that is naturally heavy such as steel, or it can be made of a lighter weight material such as plastic and filled with a material such as sand which will make the plastic base heavy. In addition, the base 7 should be wide and long enough to provide a stable platform when a user is suspended from the top of the frame.

The base also has a vinyl covered padded mat 8 placed on top of the base to provide cushioning for the user. The vertical uprights 2 are attached to the base 7 in any conventional manner which will provide a strong, stable joint between the uprights and the base.

Along each of the uprights 2 are a plurality of handholds 6 which can be rods which are inserted into apertures in the uprights. In the alternative, the rods 6 can be permanently attached to the uprights as by welding. The handholds are preferably 2 feet and three feet above the base 7, however, other dimensions can be used without departing from the scope of the invention.

Attached at the top of the uprights 2 are a second set of uprights 10 which will telescope over the lower uprights 2. In order to hold the uprights 10 with respect to the uprights 2, a series of apertures 11 are positioned through the uprights 10. An aperture 12 is positioned through the uprights 2. The height of the padded support can be adjusted by aligning an aperture 11 with the aperture 12 and inserting a pin (not shown) through the aligned apertures.

Attached to the uprights 10 is a first padded support 5 which can surround a bar 9 which is attached to the top of the uprights 2 in any conventional manner. A second padded support 4 is attached to a second bar 9 and the bar is attached to angled supports 3 which are secured to the vertical uprights 2. The angled supports 3 can be attached to the vertical uprights 2 in any conventional manner as long as they will not rotate with respect to the vertical uprights 2 while in use. Preferably, the padded support 4 will be placed on the vertical uprights 2 slightly lower than the padded support 5 so a user's knees and angles can be placed in a comfortable position while using the exercise devise 1.

In order to use the exercise device 1 a user would place the back of his/her knees over the top of the padded support 5 and then place the top of their ankles under the bottom of the padded support 4. This will have the user suspended in an inverted position with their head closest to the base 7. Since the device is only about 4 feet high, a user can sit atop the device, lower himself/herself into an inverted position using the hand holds 6 and begin exercising.

Once in the basic inverted position, the user can use the handholds 6 to help support their weight while they maneuver their body into the most comfortable position on the padded supports 4, 5. Once they are in the most comfortable position, the user merely has to use their stomach muscles to lift the upper part of their body toward the top of the uprights 2. This will work their stomach or ab muscles in an advanced manner. Also, if they have trouble lifting the upper part of their bodies up, they can use the handholds 6 to assist them until their ab muscles are strong enough to lift their upper bodies without assistance.

Although the Inverted A Cruncher and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An exercise device for exercising a user's abdominal muscles, comprising:

a base having a length, width and thickness, at least two vertical uprights attached to said base and extending upwardly above said base, said at least two vertical uprights having a bottom attached to said base and a top, a first padded support attached adjacent said top of said at least two vertical uprights, a second padded support attached adjacent said top of said at least two vertical uprights, said second padded support being attached to said at least two vertical uprights at a position lower than where said first padded support is attached adjacent to said at least two vertical uprights, and wherein at least two additional uprights are attached to said at least two vertical uprights, and means for adjusting said two additional uprights vertically with respect to said at least two vertical uprights, and wherein said second padded support is attached to a bar which is attached to angled supports, and said angled supports are attached to said at least two vertical uprights.

2. An exercise device for exercising a user's abdominal muscles, comprising:

a base having a length, width and thickness, at least two vertical uprights attached to said base and extending upwardly above said base, said at least two vertical uprights having a bottom attached to said base and a top, a first padded support attached adjacent said top of said at least two vertical uprights, a second padded support attached adjacent said top of said at least two vertical uprights, said second padded support being attached to said at least two vertical uprights at a position lower than where said first padded support is attached adjacent to said at least two vertical uprights, and wherein at least two additional uprights are attached to said at least two vertical uprights, and means for adjusting said two additional uprights vertically with respect to said at least two vertical uprights, and wherein said first padded support is attached to a bar, and said bar is attached to said at least two additional vertical uprights.

3. The exercise device as claimed in claim 2, wherein a padded mat is positioned on top of said base.

4. The exercise device as claimed in claim 2, wherein a plurality of hand holds are positioned along said vertical uprights.

* * * * *